US005224697A

United States Patent [19]

Darchis et al.

[11] Patent Number: 5,224,697

[45] Date of Patent: Jul. 6, 1993

[54] DEVICE FOR THE FORMATION OF A STACK OF FLAT ARTICLES, ESPECIALLY MAIL ENVELOPES

[75] Inventors: Pierre Darchis, Vigneux de Bret; Laurent Baufreton, Nantes, both of France

[73] Assignee: La Poste, Paris, France

[21] Appl. No.: 861,027

[22] Filed: Mar. 31, 1992

[30] Foreign Application Priority Data

Apr. 4, 1991 [FR] France ..... 91 04106

[51] Int. Cl.[5] ..... B65H 29/50

[52] U.S. Cl. ..... 271/201; 271/215; 271/3.1

[58] Field of Search ..... 271/2, 178, 200, 201, 271/215, 216, 3.1

[56] References Cited

U.S. PATENT DOCUMENTS 3,682,473 8/1972 Kutt ..... 271/201 X
3,729,191 4/1973 Yoshimura et al. .

FOREIGN PATENT DOCUMENTS 0333596 9/1989 European Pat. Off. .
946734 6/1949 France ..... 271/178
7014553 2/1971 Netherlands .

*Primary Examiner*—Robert P. Olszewski
*Assistant Examiner*—Boris Milef
*Attorney, Agent, or Firm*—Pollock, VandeSande & Priddy

[57] ABSTRACT

A device which forms a stack of flat articles such as envelopes is disclosed. A conveyor delivers flat articles to a movable carriage. The movable carriage includes a horizontal support and vertical support for aligning flat articles received. A stacking head supported on the movable carriage comprises four rotary rollers positioned at the vertices of a parallelogram. Two non-adjacent rollers are movable but maintained a fixed distance apart. The rollers support a belt which transfers received flat articles from the conveyor onto the horizontal and vertical supports. A strain-sensitive detector is coupled to the movable rollers for providing a signal to control carriage movement as the stack of accumulated flat articles increases.

4 Claims, 3 Drawing Sheets

DEVICE FOR THE FORMATION OF A STACK OF FLAT ARTICLES, ESPECIALLY MAIL ENVELOPES

The present invention relates to a device enabling a uniform stack to be made of flat articles, in particular mail envelopes supplied by a conveyor coming from a machine for processing this mail. The envelopes are presented on one of their faces and in the same direction but which may correspond to different sizes, weights or thicknesses. The envelopes may be presented at the entrance to the device in any formation, the envelopes being separated from each other or, on the contrary, partially overlapping in order to constitute a continuous line.

Stacking machines which produce a uniform stack of flat articles are known in the prior art. However, these machines have drawbacks. In particular, they generally do not equally well accommodated envelopes which are presented one by one and in tile formation where these envelopes partially overlap, possibly with variable overlap lengths from one article to another. Likewise, these known machines do not reliably take account of the pressure of the envelopes in the formed stack and the rate of formation of the stack to be adapted to this pressure.

The subject of the present invention is a stacking device which overcomes these drawbacks by enabling the articles to be stacked one by one or in tile formation, at whatever speed these articles are supplied. It also permits manual or automatic access at one end of the stack during formation with, furthermore, a minimum disruption to the qualities of uniformity of the stack and with any offset the envelopes in relation to a reference dihedral against the planes of which the envelopes progressively bear as the stack is created.

Summary of the Invention

For this purpose, the device includes a conveyor delivering the articles and, in particular, mail envelopes one by one, which are separate or with each of these envelopes being mutually overlapped by the next, and a stacking head carried by a carriage which moves with respect to a fixed chassis of the device progressively as the stack is formed. The carriage comprises at least one band made from a material having a significant coefficient of friction and driven in continuous rotation in order to entrain the envelopes in its movement, the envelope being presented with one of their edges bearing on a horizontal plane in the direction of a vertical alignment plane forming a reference dihedral with the horizontal plane. The band of the stacking head is mounted on four rotary rollers disposed ,at the vertices of a deformable parallelogram. Two of these vertices are stationary and the other two are movable but held apart by a specified amount by means of a keeper, the movable vertices moving as a function of the pressure exerted by the band on the stack being formed and measured continuously by means of a strain-sensitive detector acting on the drive for movement of the carriage parallel to the intersecting edge of the reference dihedral.

The movable carriage carrying the stacking head is preferably driven by means of a cogged belt meshing with a sprocket driven by means of a speed-reducing motor such that the progressive rotation of this sprocket as the stack is formed determines a movement of the carriage in the opposite direction.

Advantageously, the keeper, holding apart the two movable rollers of the parallelogram by a given amount, have their spindles solidly attached to a support guided in a displacement groove provided in the chassis of the movable carriage. Likewise preferably, the support of the rollers interacts with a slideway having ball bearings which is mounted in the displacement groove.

Furthermore, and according to another characteristic of the invention, a stop having a calibrated spring is associated with the stress transducer so as to enable, when the pressure on the stack exceeds a given maximum threshold, the movable rollers to move and the carriage carrying the stacking head to be disengaged.

Finally, and in a preferred embodiment of the invention, a pulse wheel is mounted substantially tangential to the plane of the band, such that the envelopes cause this wheel to rotate during their movements with the band, the wheel in this case supplying a series of pulses characterizing the positioning of these envelopes prior to their introduction into the stack for the subsequent actuation of a possible compensation mechanism.

Other characteristics of a device for the formation of flat articles, especially letter envelopes, will also emerge from the description which follows of an exemplary embodiment, given by way of non-limiting indication, with reference to the attached drawings.

DESCRIPTION OF THE FIGURES

FIG. 1 is a diagrammatic view, in perspective, of the device in accordance with the.

DESCRIPTION OF THE PREFERRED EMBODIMENT

Figure 1:
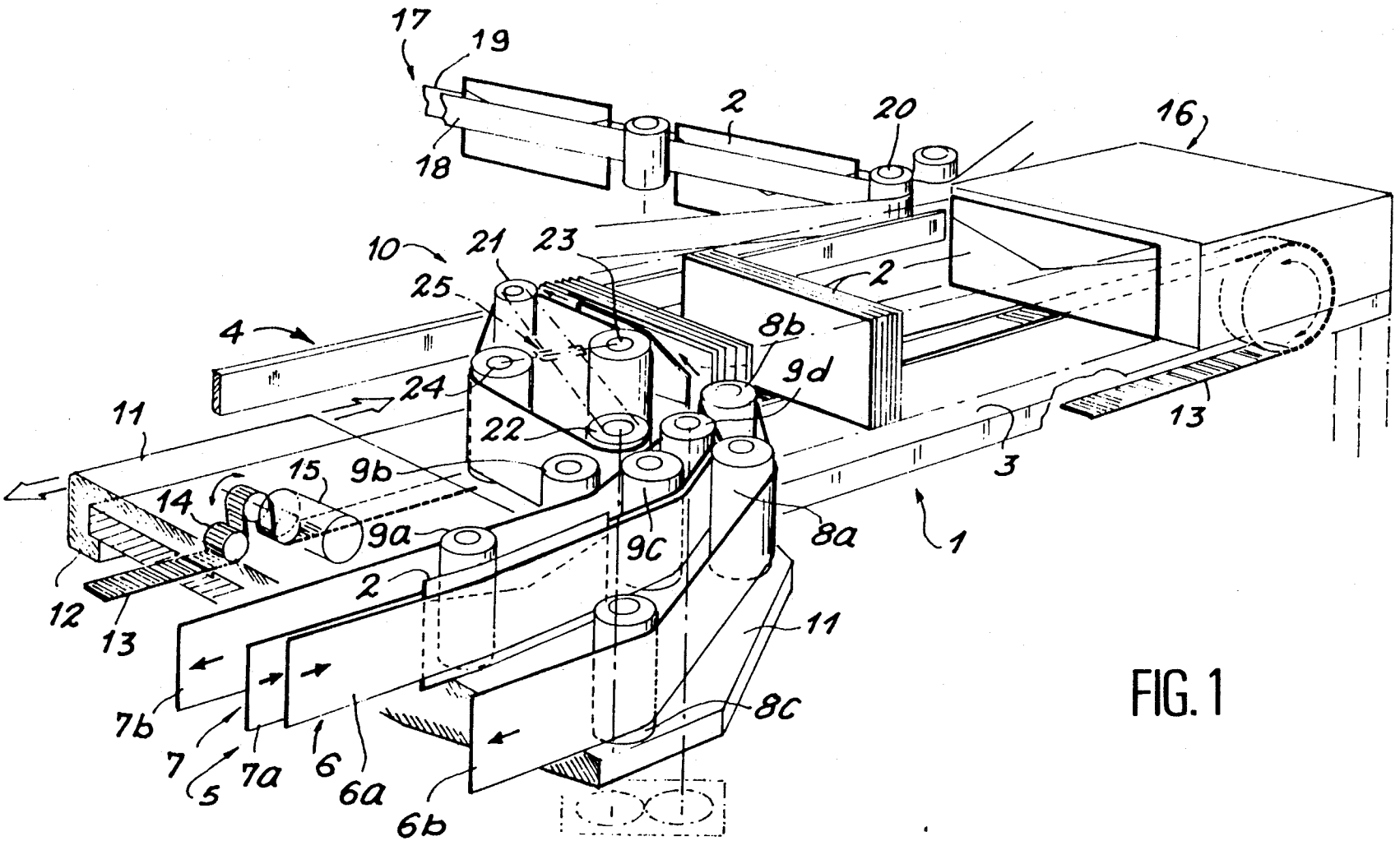

In FIG. 1, the reference 1 designates the overall device having a fixed chassis for the of a stack of flat articles according to the invention, these articles being especially constituted by envelopes 2 which, in the example have the same size but which, as variants, could have different dimensions from one another to a certain extent. These envelopes furthermore may have thicknesses and weights which are not necessarily the same from one envelope to the next.

The envelopes 2 rest on a horizontal plane support 3 by their lower edges or borders and are laterally aligned on one of their sides by means of a vertical strip 4, the planes of the support and of the strip 4 forming in particular a reference dihedral for the stack of the envelopes 2.

These envelopes 2 are moved forward towards the device by means of a conveyor assembly 5 comprising, as is conventional in any mail-sorting installation, two parallel belts, respectively 6 and 7, capable of gripping the envelopes between them in order thereby to move, at the same time as the belts, the envelopes which can be separate or mutually overlap each other in so-called tile formation.

In the example shown, the belt 6 is guided over the cylinders or rollers, respectively 8*a*, 8*b*, 8*c* against which the forward 6*a* and then the return 6*b* sides of this belt bear. In the same manner, the belt 7 is guided by means of rollers 9*a*, 9*b*, 9*c*, 9*d* with its forward 7*a* and return 7*b* sides partially going around these rollers according to the path specified by the latter. In particular, it is seen that the rollers furthest away, respectively 8*b* for the belt 6, 9*d* for the belt 7, are disposed such that each of the envelopes 2 is distributed at the end of the conveyor 5 towards a stacking head 10 which is designed in such a manner as to entrain these envelopes one by one, by suitably positioning them in the dihedral formed by the support 3 and the strip 4.

The stacking head 10 is supported by a movable carriage 11 which moves with respect to the chassis X. The carriage 11 comprises laterally a rim 12 going around the side of the support 3 such that the movement of the carriage can be performed parallel to the intersecting edge of the abovementioned reference dihedral, progressively as the stack is formed and, in particular, as the thickness of the latter varies. This movement is especially produced, in a way known per se, by means of a cogged belt 13 which is guided over toothed cylinders 14, at least one of which is driven by a speed-reducing motor 15 carried by the carriage. It should be noted that the carriage 11 extends transversely with respect to the head 10 in such a manner as to support the guide rollers of the belts 6 and 7 which thus move with the carriage, the conveyor 5 being provided with means (not shown) enabling the slack in the belts to be taken up continuously depending on the position of the carriage.

The stack of envelopes 2 is thus formed between the stacking head 10 and a fixed support frame 16, shown diagrammatically in FIG. 1, enabling these envelopes to be extracted one by one from this stack, either with a given separation between each of the envelopes as illustrated in the drawing, or in regular tile formation where these envelopes mutually overlap over a portion of their length, the envelopes being taken up in a removal conveyor 17 comprising, like the feed conveyor 5, at least two parallel belts 18 and 19 gripping the envelopes between them, these belts being guided over rollers 20 having parallel spindles. Advantageously, the support frame 16 comprises a suitable destacking head whose characteristics are preferably in accordance with those described and shown in French Patent Application No. 91 040 46 filed on 3rd Apr. 1991 in the name of the Applicants for a "Device for extracting flat articles one by one from a stack of such articles, especially letter envelopes"and U.S. counterpart, Ser. No. 07/861,026.

The stacking head 10 is constituted by means of four rollers having parallel spindles disposed at the vertices of a rhombus, the rollers 21 and 22 being provided along the large diagonal of the latter and the rollers 23 and 24 along the small diagonal. The spindles of the rollers 21 and 22 are carried by the carriage 11 and are therefore immobilized in relative position in relation to the latter, whereas the spindles of the other two rollers 23 and 24 are supported by means of a keeper 25 which keeps these spindles apart by a specified amount.

Figure 2:
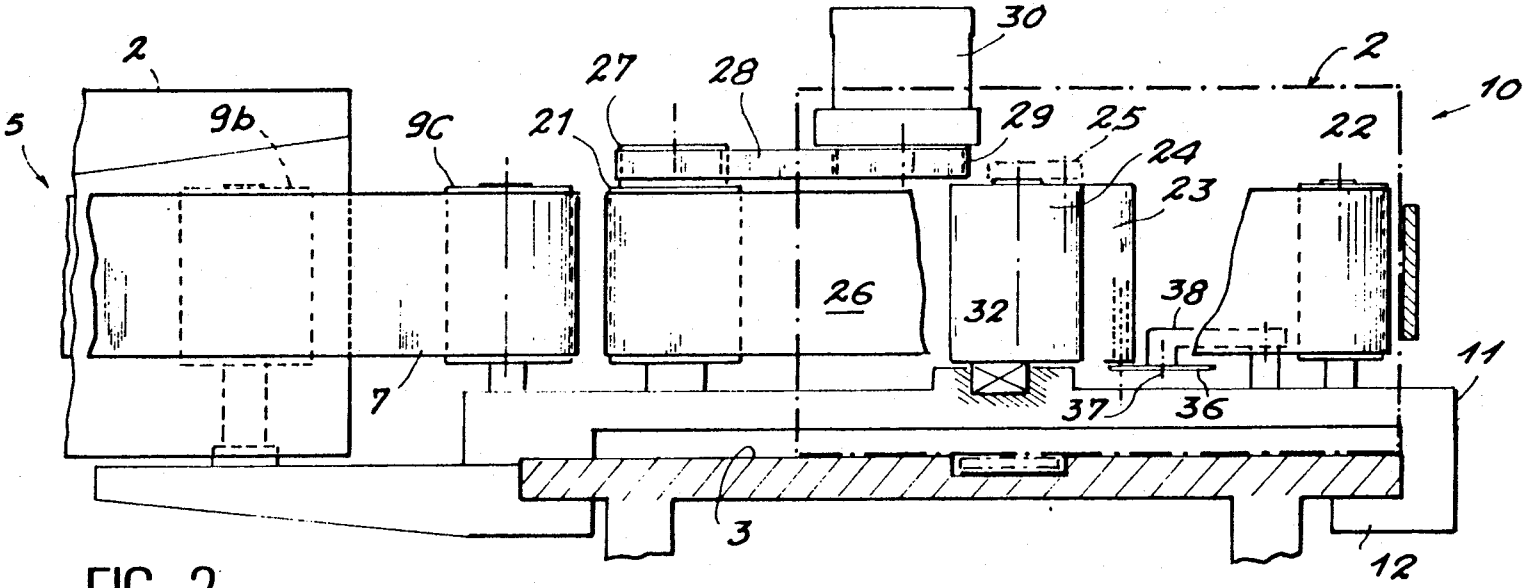
FIG. 2 is a view, in transverse cross-section and on a larger scale, of the stacking head utilized in the device.
Figure 3:
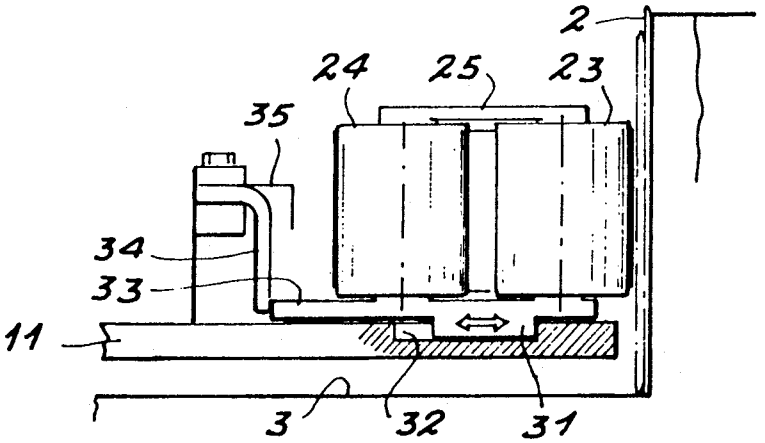
FIG. 3 is a view, in cross-section in a plane perpendicular to that of FIG. 2, illustrating more particularly the relative position of the slideway having ball bearings for the movement of the movable rollers of the stacking head.
Figure 4:
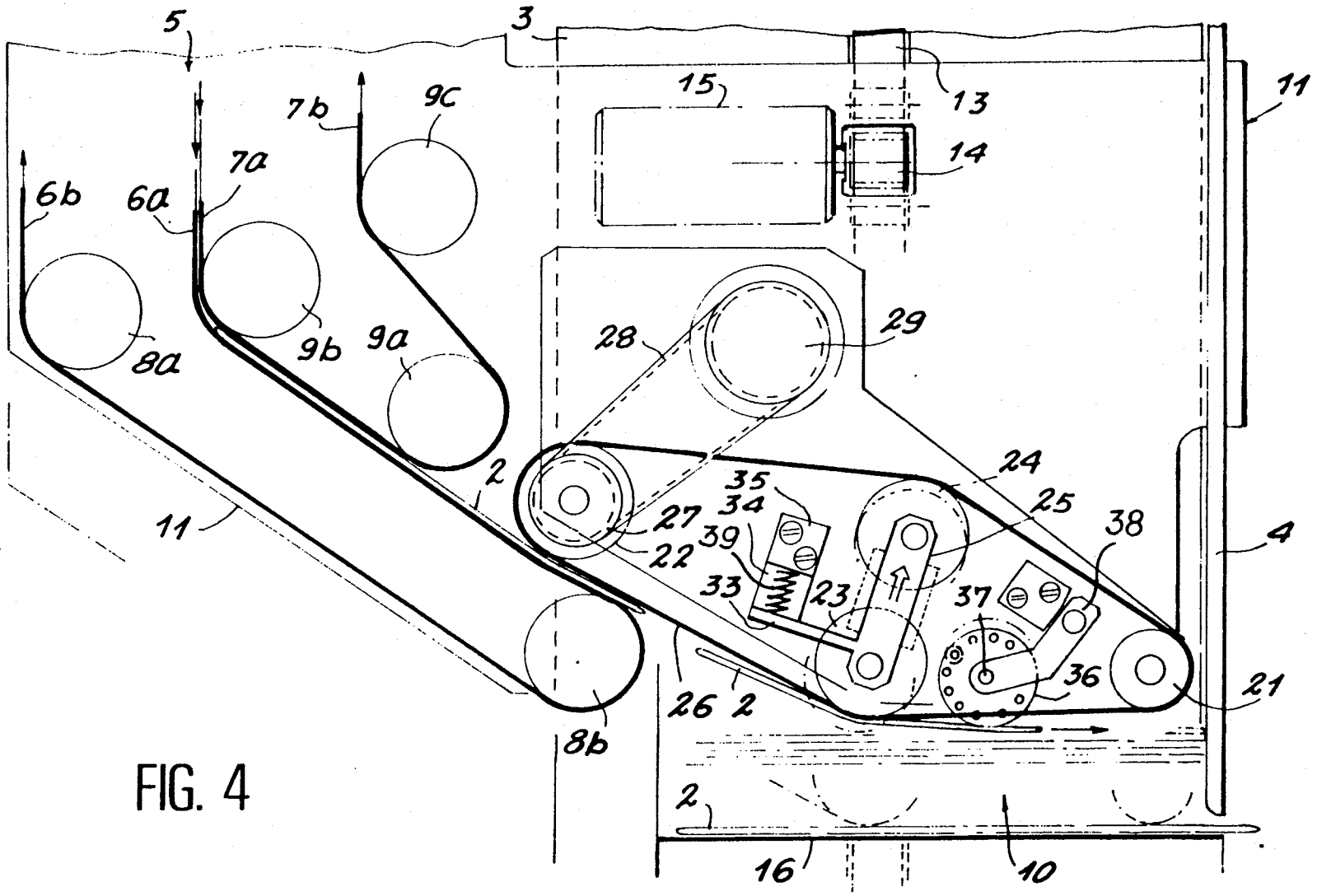
FIG. 4 is a top view of the stacking head and movable carriage of FIG. 1.

FIGS. 2 to 4 illustrate more particularly the structure of the various portions of the device and, especially, of the stacking head 10.

As is seen in these figures, the head 10 comprises an entrainment belt 26 stretched over the four rollers 21 to 24. One of the rollers whose spindle is carried by the carriage 11, for example the roller 22, includes a driving sprocket 27 whose rotation is caused by means of a drive belt 28 which is itself engaged by a coupling mechanism (not shown) with a second sprocket 29 which is keyed or otherwise solidly connected to the shaft of a speed-reducing motor 30, in such a manner that this rotation is synchronized to the speed for introducing the envelopes 2 at the exit of the conveyor 5. The belt 26 is made from a material having a suitable, relatively high, coefficient of friction such that, during its rotation around the rollers 21 to 24, it progressively entrains the envelopes 2 as the latter are presented in front of it at the exit of the conveyor 5 between the sides 6*a* and 7*a* of the belts 6 and 7, in line with rollers 8*b* and 9*d* as shown in FIG. 4 especially. Furthermore, the spindles of the rollers 21 and 22 are disposed such that the envelopes 2 which are placed in the bottom of the reference dihedral form a limited but specified angle with the band.

According to the invention, the two rollers 23 and 24, joined together by means of the spacing keeper 25 and disposed along the direction of the small diagonal of the rhombus whose sides are delimited by the belt 26, are mounted in such a way that they can slide together parallel to this direction, by virtue of a support 31 slidably mounted in a slideway 32 which is provided at the lower portion of these rollers in the surface facing the carriage 11. The support 31 moreover comprises a lateral extension 33 provided for interacting with a stop 34 acting on a strain gauge 35 which is capable of indicating, as a function of its deformation under the thrust of the support 31, the value of the pressure exerted on the stack of envelopes and consequently acting on the speed-reducing motor 15 moving the carriage. A calibrated spring 39 is associated with the stop 34 so as to keep the gauge 35 strained as long as the pressure on the stack of envelopes does not exceed a specified maximum threshold, corresponding to the limiting deformation of the gauge, and to allow the latter to escape in the event of possible excess pressure without damaging it, for example in the event of a pile-up in the stack or of an article of excessive thickness being placed in the latter.

The device is completed by means of an optical pulse wheel 36, mounted so as to rotate freely about a spindle 37, provided on the end of a support arm 38, this wheel being mounted approximately tangentially to a lateral plane of the rhombus delimited by the entrainment belt 26 is driven in continuous rotation by the latter in such a way as to supply a series of pulses enabling the positioning of the envelopes with respect to a given reference to be measured, so as in particular to control, by means of this information, the drive of the destacking head in the support frame 16 opposite the stacking head 10 and especially to act on a possible compensation mechanism.

The proposed device therefore enables the pressure of the stack of envelopes on the destacking head thus to be continuously measured, such information being indispensable for the precise control of the movements of the movable carriage. The regulation of this pressure is adjusted in such a way that it both maintains the stack and keeps a minimum adherence of each envelope with respect to the entrainment band without, at any instant, impeding its insertion into the latter. For this purpose, the strain-sensitive pressure detector is adapted to supply very accurate values, even for a small deformation of this detector, by enabling thereafter the angle with which the envelopes are introduced into the stacking head to be kept practically constant, this angle constituting an essential parameter for establishing and maintaining the stack, whatever the size, thickness and weight of the envelopes processed.

Of course, it goes without saying that the invention is not limited to the exemplary embodiment more especially described and shown hereinabove; on the contrary, it embraces all variants thereof.

We claim:

1. A device for forming a stack of flat articles comprising:

a conveyor for delivering said flat articles one by one;

a movable carriage which moves with respect to a chassis as a stack of flat articles is received from said conveyor and accumulates on said chassis;

said chassis including a horizontal support and vertical support forming a corner which aligns said flat articles as they are received into a stack of accumulated flat articles;

a stacking head supported on said movable carriage comprising four rotary rollers positioned at the vertices of a parallelogram, two non-adjacent rollers being stationary, and the two remaining rollers being movable together and maintaining a fixed distance apart by keeper means, said rollers supporting a belt which transfers said flat article from said conveyor into place on said horizontal and vertical supports, said movable rollers moving in response to pressure exerted by said accumulated stack of flat articles against said belt; and, a strain-sensitive detector coupled to said movable rollers for providing a signal for controlling movement of said carriage as said stack increases.

2. A device according to claim 1, wherein the movable carriage carrying the stacking head is driven by a cogged belt meshing with a sprocket driven by a speed-reducing motor such that the progressive rotation of said sprocket as the stack increases results in a movement of the carriage in a direction to provide room for said stack.

3. A device according to claim 1, wherein the keeper means, holding apart the two movable rollers of the parallelogram, have spindles solidly connected to a support guided in a displacement groove provided in the movable carriage.

4. A device according to claim 1, further comprising a pulse wheel mounted substantially tangential to the plane of the belt such that the flat articles cause this wheel to rotate when they are moved by the belt, the wheel supplying a series of pulses characterizing the positioning of said flat articles during their introduction into the stack.

* * * * *